United States Patent [19]

Niewald et al.

[11] Patent Number: 4,571,142

[45] Date of Patent: Feb. 18, 1986

[54] MECHANISM FOR LIFTING VEHICLE TIRES

[76] Inventors: Jack L. Niewald, P.O. Box 224, Clinton St.; Eugene W. Kelch, Rural Rte., both of Corwith, Iowa 50430

[21] Appl. No.: 579,349

[22] Filed: Feb. 13, 1984

[51] Int. Cl.[4] ..... B66F 5/00

[52] U.S. Cl. ..... 414/427; 254/2 R

[58] Field of Search ..... 414/426, 427, 433; 254/2 R

[56] References Cited

U.S. PATENT DOCUMENTS

| | | | |
|---|---|---|---|
| 1,591,193 | 7/1926 | Weaver | 414/428 X |
| 1,964,119 | 6/1934 | Hendry | 414/427 |
| 2,490,233 | 12/1949 | Schildmeier | 414/427 |
| 2,558,535 | 6/1951 | Billings | 254/2 R |
| 2,883,858 | 4/1959 | Bishman | 414/433 X |
| 3,653,527 | 4/1972 | Seymour | 414/427 |
| 4,401,405 | 8/1983 | Ealet | 414/428 |

FOREIGN PATENT DOCUMENTS

| | | | |
|---|---|---|---|
| 897593 | 1/1982 | U.S.S.R. | 414/426 |

*Primary Examiner*—Robert J. Spar
*Assistant Examiner*—Stuart J. Millman
*Attorney, Agent, or Firm*—Zarley, McKee, Thomte, Voorhees & Sease

[57] ABSTRACT

A mechanism for lifting vehicle tires which includes a base framework which is movable along the ground. An elongated mast extends upwardly from the base framework and has a masthead which is movable along the mast. An arm extends outwardly from the masthead and has at its outer end two tandem wheels which are aligned in the same plane and have rotational axes parallel to one another in a horizontal plane. A jack on the base framework is operably connected to the masthead and allows selective lifting and lowering of the masthead. The tandem wheels engage the top inside of the rim of the vehicle tire and cause the vehicle tire to be lifted when the masthead is lifted. When lifted, the tire may be rotated because it is supported only by the rotatable tandem wheels. The tire may also be transported when in a lifted position.

12 Claims, 7 Drawing Figures

MECHANISM FOR LIFTING VEHICLE TIRES

BACKGROUND OF THE INVENTION

1. Field of the Invention

This invention relates to a lifting mechanism, and more particularly, to a mechanism for lifting vehicle tires.

2. Problems in the Art

Large and heavy vehicle tires present handling problems. Changing and/or maintenance of these tires is difficult and usually requires specialized equipment.

An example of such tires are the large drive wheels for farm tractors. The particular problem exists in the handling of dual wheels, in that the outside dual wheels of the tractors are added and removed depending on the selected use of the tractor.

Most of the devices known in the art which attempt to help with handling large and heavy tires either utilize a framework to cradle the tire or have some type of means to grasp the outer perimeter of the tire. Once cradled or grasped, the tire thus being supported, can either be moved, raised or lowered.

Problems and deficiencies do exist with these devices. For the cradling devices, the vehicle itself must be jacked up a sufficient height to, at a minimum, equal the level of the tire as it sits in its lowest position in the cradle. For large and heavy vehicles, such as farm tractors, to which the tires belong, it is advantageous to have to raise the vehicle as little as possible. The cradle mechanisms also require supplemental supporting structure to keep the tire upright and secure. This additionally means that the raising and lowering mechanism is fairly complicated and requires structure additional to the holding or cradling structure.

The perimeter grasping devices many times require intricate complicated grasping structure to insure secure holding of heavy, large tires. The special nature and very large diameter of farm tractor drive wheels makes perimeter grasping devices particularly unsatisfactory. The raised tread and the extreme size and weight of a tractor drive wheel would not favor such devices. Maintenance and repair of tires usually requires some rotation of the tire, whether it be for checking the tire or finding and repairing certain locations on the tire. Similarly, adding or removing a tire usually requires either some rotation of the tire or the hub to match the studs with the rim holes. The cradling or perimeter grasping devices do not adequately allow such rotation and it is particularly advantageous for such to be able to occur.

It is therefore an object of the invention to provide a mechanism for lifting vehicle tires which allows rotation of the tire while being lifted and supported by the mechanism.

A further object of this invention is to provide a mechanism for lifting vehicle tires which lifts and supports the tire by contacting the interior rim of the tire.

A further object of this invention is to provide a mechanism for lifting vehicle tires wherein the only points of contact with the tire are on the tire's interior rim.

Another object of this invention is to provide a mechanism for lifting vehicle tires which requires minimal raising of the vehicle itself to remove or add the tire from or to the vehicle.

Another object of this invention is to provide a mechanism for lifting vehicle tires which is adaptable to many different sizes of vehicle tires.

A further object of this invention is to provide a mechanism for lifting vehicle tires which is uncomplicated in structure, economical, and efficient.

Another object of this invention is to provide a mechanism for lifting vehicle tires which allows selective lifting, lowering, supporting, rotating, and transport of vehicle tires.

A further object of this invention is to provide a mechanism for lifting vehicle tires which is easily movable and maneuverable along the ground.

These and other objects, features and advantages of the invention will become apparent with reference to the accompanying specification including the drawings.

SUMMARY OF THE INVENTION

This invention utilizes a base framework having ground-contacting means to allow easy movement along the ground. A superstructure extends upwardly from the base framework which includes a mast which has a masthead which is adjustable along the mast. The masthead has an arm which extends outwardly and has a vehicle tire contacting means secured at its outer end.

The vehicle tire contacting means has two side-by-side rotatable members which are disposed in the same vertical plane and have rotational axes disposed in the same horizontal plane.

A jack means is secured to the base framework and abuts the masthead so that upon operation of the jack, the masthead and the attendant extention arm and vehicle tire contacting means can be selectively raised or lowered. The support of the vehicle tire by the tandem wheels allows the vehicle tire to be rotated While lifted and supported by the mechanism.

DETAILED DESCRIPTION OF THE PREFERRED EMBODIMENT

Figure 1:
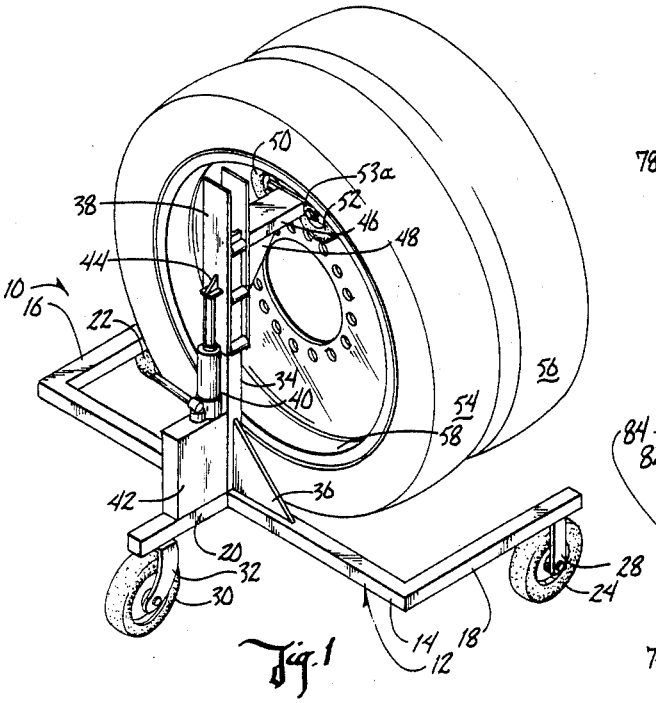
FIG. 1 is a perspective view of the invention in operative position with a vehicle tire.

In reference to the drawings, and particularly FIG. 1, there is shown a mechanism for lifting vehicle tires 10 in accordance with the invention. A base framework 12 is comprised of an elongated center piece 14 having end arms 16 and 18 extending perpendicularly from opposite ends of center piece 14, and a middle arm 20 extending perpendicularly in an opposite direction to end arms 16 and 18 from the middle of center piece 14. Wheels 22 and 24 are rotatably attached to yokes 26 and 28 which are in turn secured to end arms 16 and 18 respectively. Wheel 30 is rotatably attached to swivelable yoke 32 which is attached to middle arm 20. All wheels 22, 24 and 30 extend downwardly from a framework 12 and contact the ground to allow the invention 10 to be easily moved along the ground. The swivelability or pivotability of yoke 32 allows the invention 10 to be steered as it is moved and maneuvered to a desired position.

Figure 4:
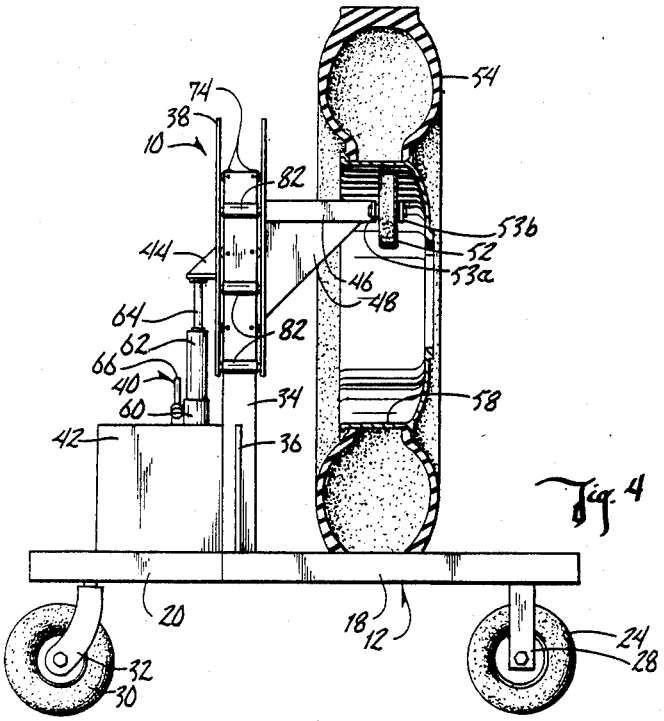
FIG. 4 is a side elevational view of the invention with the vehicle tire shown in cross-section.

The downwardly extending legs of yoke 32 are angled or curved from the vertical to cause wheel 30 to turn in the direction the invention 10 is pushed or pulled (see FIGS. 1 and 4).

A mast 34 extends upwardly from the middle of center piece 14 and can have support pieces such as gusset 36 secured between it and center piece 14 for greater stability and strength. A masthead 38 is vertically movable along mast 34 by means of a jack 40 which is secured at its lower end to platform member 42 on middle arm 20, and abuts at its top end projection 44 from masthead 38.

An extension arm 46 extends outwardly and horizontally from masthead 38 in the same direction as end arms 16 and 18. A support piece such as gusset 48 can be used to increase the strength and stability of extension arm 46.

Two small tandem wheels 50 and 52 are rotatably secured to the very end of extension arm 46. Tandem wheels 50 and 52 are positioned so that they are vertically upright in the same vertical plane, and have rotational axes in the same horizontal plane. By referring to FIG. 3 it can be seen that an inside bar 53*a* is rigidly secured horizontally across the very end of extension arm 46. This can be accomplished by welding or otherwise an identical outside bar 53*b* parallel to inside bar 53*a* and spaced apart from it by connecting bar 53*c*. Parallel axles rotatably holding wheels 50 and 52 pass between opposite ends of bars 53*a* and 53*b*. Tandem wheels 50 and 52 are spaced a few inches apart from one another.

The invention 10 is brought into operative engagement with vehicle tires such as the dual wheel tire combination shown in FIG. 1. Maneuvering it towards dual tires 54 and 56 so that end arms 16 and 18 pass on either side of dual tires 54 and 56 and extension arm 46 extends into the interior space defined by rim 58 of outside dual tire 54.

Figure 2:
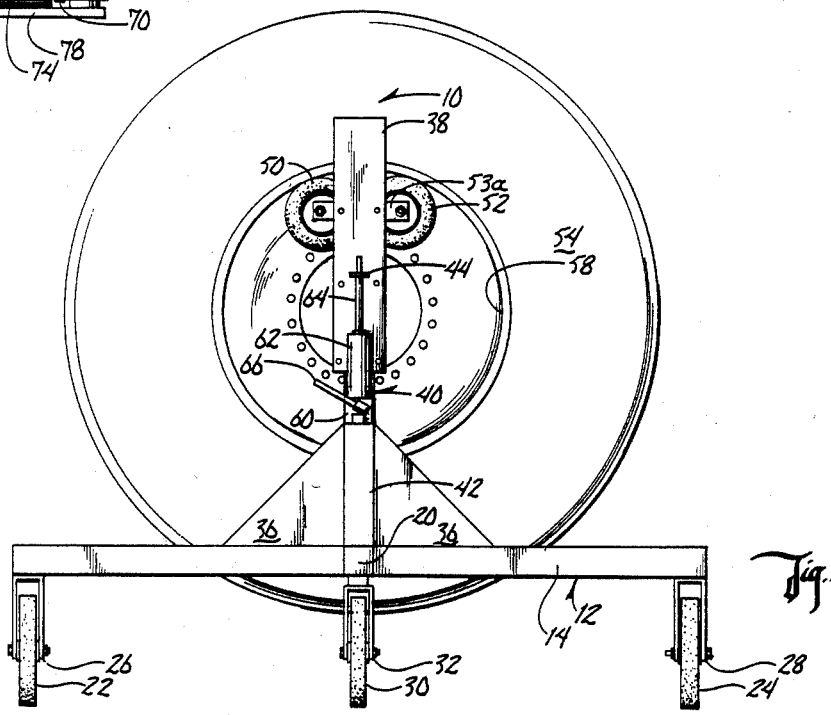
FIG. 2 is a front elevational view of the invention as seen in FIG. 1.
Figure 3:
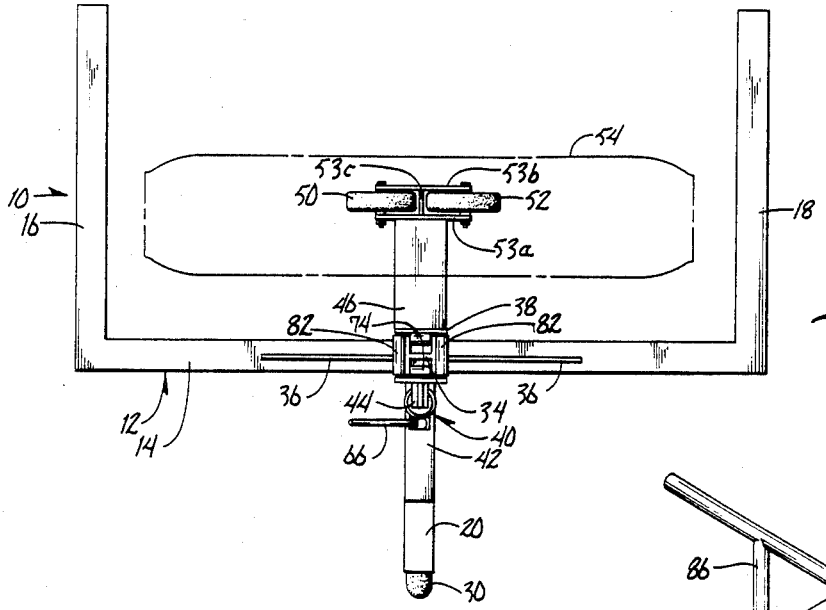
FIG. 3 is a top plan view of the invention with a vehicle tire marked in ghost lines.

Jack 40 is then operated to raise masthead 38, and therefore extension arm 46 and tandem wheels 50 and 52, along mast 34 until tandem wheels 50 and 52 contact the top inside portion of rim 58. By continuing to operate jack 40 to lift masthead 38, outside dual tire 54 can be lifted off the ground as is shown in FIG. 2. FIGS. 2, 3 and 4 illustrate how the contact of tandem wheels 50 and 52 with the inside of rim 58 holds tire 54 in a centered upright and stable position even when lifted off the ground. In this equalibium state, tire 54 may be manually rotated. This is allowed by the rotatability of tandem wheels 50 and 52.

FIG. 3 illustrates how tire 54 (shown in ghost lines) is held in a centralized upright position between end arms 16 and 18. Tandem wheels' 50 and 52 location at the very end of extension arm 56 allows them to contact towards the back and the inside of rim 58 so that tire 54 can be better balanced when lifted off the ground. FIG. 3 also illustrates the stability and balance of Y-shaped base framework 12 and how it can be maneuvered to operate on a variety of sized tires.

FIG. 4 illustrates in detail the operability of masthead 38. Jack 40, which can be a standard hydraulic jack, has a base 60 secured to platform 42. Hydraulic cylinder 62 extends upwardly from base 60. Piston 64 extends from the top of hydraulic cylinder 62 to where it abuts projection 44 of masthead 38. Piston 64 is either raised or lowered according to desired operation of jack handle 66, as is known in the art. The weight of masthead 38 causes projection 44 to be in constant contact with the top of piston 64 and therefore masthead 38 moves in response to the upward or downward movement of piston 64.

Figure 5:
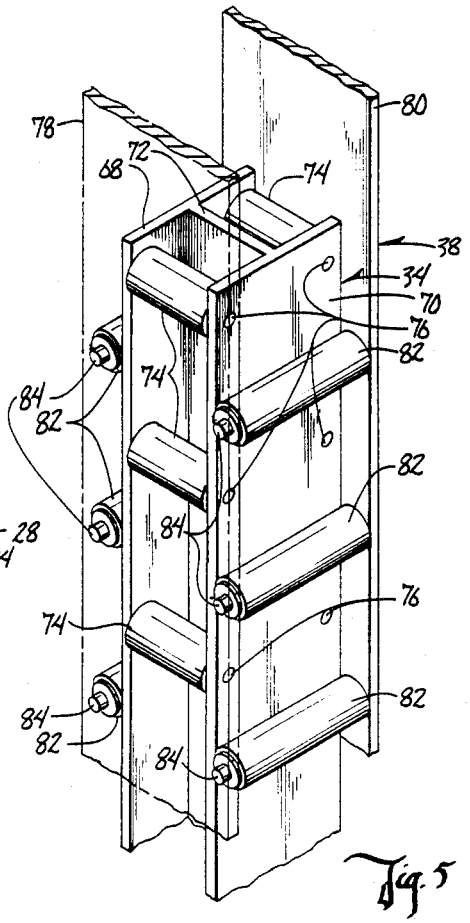
FIG. 5 is a partial perspective view of the masthead of the invention with portions of the masthead drawn in ghost lines.

The exact structure of masthead 38 and the top of mast 34 can be seen in FIG. 5. In the preferred embodiment, mast 34 is an I-beam having outer opposite sides 68 and 70 connected by center piece 72. Rollers 74 are rotatably secure in both channels of mast 34 on either side of centerpiece 72 by pins 76 extending between opposite sides 68 and 70. As can be seen in FIG. 5, rollers 74 extend a distance beyond the vertical edges of opposite sides 68 and 70.

Masthead 38 is constructed of two opposite, spaced apart plates 78 and 80 which are secured to one another by rollers 82 and pins 84 extending horizontally between adjacent vertical edges of plates 78 and 80, as shown in FIG. 5. Rollers 82 are rotatable around pins 84 and are uniformly spaced along masthead 38.

Masthead 38 is positionable over mast 34 so that rollers 82 of masthead 38 come into frictional contact with the outer surfaces of opposite sides 68 and 70 of mast 34. The rollers 74 of mast 34 likewise come into frictional contact with the inner facing surfaces of plates 78 and 80.

Figure 6:
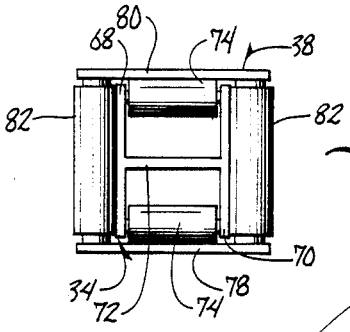
FIG. 6 is an enlarged top plan view of the mast and masthead

Therefore, masthead 38 is kept in constant alignment with mast 34 and is allowed to freely but securely roll along the length of mast 34. This relationship between masthead 38 and mast 34 is shown in detail in FIG. 6.

Figure 7:
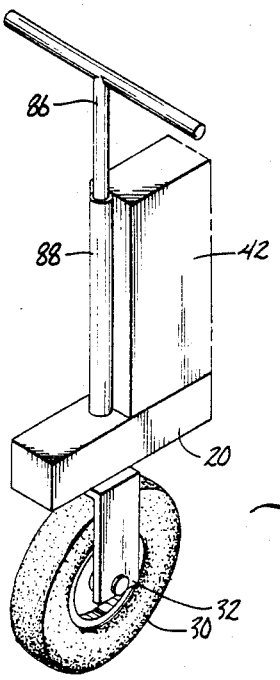
FIG. 7 is a partial perspective view of the steering mechanism of the invention.

FIG. 7 depicts an alternative embodiment for the steering of the invention 10. Instead of merely having a swivelable wheel 30 and curved or angled yoke 32, as shown in FIG. 1, yoke 32 could have legs extending straight downward and could be attached to a T-bar 86 which extends through middle arm 20 of base framework 12. T-bar 86 could be rotatably secured within rigid tube 88 which could be rigidly secured to platform 42. Thus, wheel 30 could be rotatably steered by the rotation of T-bar 86 within tube 88, giving the user of invention 10 a convenient grip and control of which direction wheel 30 is turned.

In operation, the invention 10 functions as follows. If a vehicle tire 54, such as shown in FIG. 1, is desired to be removed from a vehicle, invention 10 is maneuvered to the position in FIG. 1 with end arms 16 and 18 straddling opposite sides of tire 54. Before moving the invention 10 to this position, the user must be sure that masthead 38 is lowered below the top inside portion of rim 58 of tire 54. Jack 40 is then operated to raise piston 64, and consequently masthead 38 and tandem wheels 50 and 52, until they contact the upper inside portion of rim 58 and lift tire 54 off the ground. Assuming the studs securing tire 54 to the vehicle have been removed, the invention 10 is simply moved back away from the vehicle and tire 54 is moved away with it. At this point, tire 54 could be fixed or inspected in the raised position, this being easily accomplished because tire 54 can be rotated in that position because of tandem wheels 50 and 52. Tire 54 can also be easily transported to any desired location by simply moving invention 10 along the ground. Front wheel 30, steers invention 10 in any direction which base framework 12 is pushed because of the slanted angle of yoke 32. In the alternative embodiment of FIG. 7, the user simply orients T-bar 86 in the desired position to turn wheel 30 in the desired direction.

To replace a tire 54 back on a vehicle, the procedure described above is reversed. Replacement of tire 54 to the vehicle is made much easier because tire 54 can be freely rotated for easy axle and stud alignment.

In the preferred embodiment shown in the drawings, center piece 14 is 4"×3/16" square tubing and is 78" long. End arms 16 and 18 are 4"×3/16" square tubing, each being 30" long. The downwardly extending legs of yokes 26, 28 and 32 are made from 4"×8½" mild steel plate and are connected by 4"×4"×½" mild steel plate. Wheels 22, 24 and 30 are 12" outside diameter by 3" wide pneumatic tires with the rims having a center ¾" bore for ¾", 4" long cold rolled round axles. Swivelable yoke 32 is connected to the bottom of middle arm 20 by a ¾" inside diameter bearing.

Mast 34 is a 42" long 4"×4" I-beam and is supported at its lower end by two 12"×12"×17"×⅜" mild steel gussets 36. Plates 78 and 80 of masthead 38 are 7"×30"×½" mild steel plates. Rollers 82 are 1¾" rollers having a ¾" central bore and are 4¼" long. Pins 84 are ¾" cold rolled round and 5¼" long. Rollers 74 of mast 34 are 1¾" rollers, 3" long and have a ¾" central bore for pin 76 which are ¾" cold rolled round and 4" long.

Extension arm 46 is 3" wide ×14" long ×½" thick mild steel plate and is supported to masthead 38 by a 12"×12"×17"×⅜" mild steel gusset 48. Tandem wheels 50 and 52 are 10" outside diameter rubber covered wheels having a ¾" central bore for ¾" cold rolled round 4" long axles. Inside and outside bars **53*a* and 53*b* are 3"×15"×½" mild steel plates. Connecting bar 53*c* is a 3"×4"×½" mild steel plate and passes between tandem wheels 50 and 52. Projection 44 can be made of a horizontally positioned 3"×½" mild steel plate supported by a 3"×3"×¼"×½" mild steel gusset extending above and between the horizontal plate and mast 34**.

Jack 40 can be a one ton hydraulic jack having a 12" stroke. Platform 42 can be constructed out of 12" × 12" × ⅜" mild steel plate.

The overall dimensions of the preferred embodiment are 53" from the outermost end of middle arm 20 to the outermost ends of end arms 16 and 18, and 60" from the bottom of wheels 22, 24 and 30 to the top of mast 34.

It will be appreciated that the present invention can take many forms and embodiments. The true essence and spirit of this invention are defined in the appended claims and it is not intended that the embodiment of the invention presented herein should limit the scope thereof.

What is claimed is:

1. A device for lifting, supporting, lowering and transporting a vehicle tire having a rim comprising:

a base framework having ground-contacting means to allow said device to be easily moved along the ground;

a mast extending upwardly from said base framework;

a masthead which is adjustably securable to said mast and which may be moved along said mast;

an extension means; said extension means comprising a laterally extending arm extending outwardly from said masthead and having an outer end and a longitudinal axis;

a vehicle tire contacting means secured to said outer end of said arm of said extension means comprising tandem wheels rotatably mounted in a mounting means, said tandem wheels being coplanar and close together but spaced apart laterally with respect to said longitudinal axis of said extension means a distance no greater than the inside diameter of said rim, said tandem wheels being contactable with the interior of said rim of said vehicle tire and allowing rotation of said tire when said wheels are in contact with said rim; and jack means on said base framework operably connected to said masthead for selective raising and lowering of said masthead which in turn raises and lowers said vehicle tire when engaged with said vehicle tire contacting means.

2. The device of claim 1 wherein said base framework comprises a frame having an elongated center piece, first and second arms extending in the same horizontal direction from opposite ends of the center piece, and a third arm extending horizontally from the center of the center piece in the opposite direction of said first and second arms, said ground-contacting means being placed one on each arm, said first and second arms being displaced a distance apart which is greater than the width of said vehicle tire to which said mechanism is to be used, said mast being attached at the junction of said third arm with said center piece.

3. The device of claim 1 wherein said ground-contacting means comprise casters, at least one of said casters being swivelable for steering purposes.

4. The device of claim 1 wherein said mast comprises an elongated member rigidly secured at its lower end to said base framework and extending vertically upward therefrom.

5. The device of claim 4 wherein said mast is an I-beam having channels on opposite sides of a connecting middle piece.

6. The device of claim 1 wherein said masthead comprises two elongated metal plates which are disposed along opposite sides of said mast and interconnected by supporting members, said masthead having means for allowing adjustable movement of said masthead along said mast.

7. The device of claim 6 wherein said means for allowing adjustable movement of said masthead comprises roller means which are rotatably connected to said masthead and contact said mast so that said masthead is slidably adjustable along said mast.

8. The device of claim 5 further comprising rotatable rollers secured in said channels of said I-beam, said rollers extending outside the perimeter of the I-beam to come into rollable contact with said masthead to assist in facilitating the adjustable movement of said masthead along said mast.

9. The device of claim 1 wherein said mounting means secures said axles of said tandem wheels between inside and outside beams positioned transversely to said outer end of said extension means and to said axles.

10. The device of claim 1 wherein said jack means comprises a conventional hydraulic jack having a housing which is secured to said base framework, a piston having an upper end abutting said masthead and which is raisable and lowerable to selected positions, and a means for selectively raising and lowering said piston.

11. The device of claim 1 wherein said masthead further comprises a projection extending outwardly from said masthead to which the jack means is abuttingly placed so that by raising and lowering said jack means, said projection is contacted and as a result, raises or lowers said masthead.

12. The device of claim 1 wherein said tandem rotatable wheels have a non-slipping surface.

* * * * *